US006230727B1

(12) United States Patent
Chen

(10) Patent No.: US 6,230,727 B1
(45) Date of Patent: May 15, 2001

(54) COLLAPSIBLE CANOPY

(76) Inventor: Fengchun Chen, Room 303, No. 5, Lane 59, Huazhong Street, Minglounanqu, Jiangdong District, Ningbo City, Zhejjiang, 315040 (CN)

( * ) Notice: Subject to any disclaimer, the term of this patent is extended or adjusted under 35 U.S.C. 154(b) by 0 days.

(21) Appl. No.: 09/332,596

(22) Filed: Jun. 14, 1999

(30) Foreign Application Priority Data

Jun. 16, 1998 (CN) ..... 98 2 15755

(51) Int. Cl.[7] ..... E04H 15/28

(52) U.S. Cl. ..... 135/98; 135/127; 135/131; 135/145; 135/25.2; 135/25.31

(58) Field of Search ..... 135/98, 131, 145, 135/127, 20.1, 20.3, 25.2, 25.31, 25.32, 25.41

(56) References Cited

U.S. PATENT DOCUMENTS 4,193,415 * 3/1980 Hermanson ..... 135/25.1
4,601,301 * 7/1986 Hermanson ..... 135/25.1
5,263,505 * 11/1993 Yeon ..... 135/20.1
5,701,923 * 12/1997 Losi ..... 135/131
5,758,677 * 6/1998 Wang ..... 135/24
5,794,640 * 8/1998 Jang ..... 135/131
5,813,425 * 9/1998 Carter ..... 135/145

* cited by examiner

*Primary Examiner*—Beth A. Stephan
(74) *Attorney, Agent, or Firm*—Seed Intellectual Property Law Group PLLC

(57) ABSTRACT

A collapsible canopy which may be used to supply shelter from sun and rain for outdoor activities is provided and includes a post, a slide bracket slideably received on the post and a scissor assembly connected to the post and the bracket, respectively, and being formed by a plurality of scissor units connected in end-to-end relation. A plurality of pairs of upper and lower connecting members, each pair being pivotally connected with cover support members and strutting members, are pivotally connected to the ends of the cross members of the scissor units. Each strutting member is pivotally connected at one end thereof to the middle portion of its respective cover support member. A reeling device is attached to the post and has a cable fixedly attached to the slide bracket.

16 Claims, 3 Drawing Sheets

COLLAPSIBLE CANOPY

BACKGROUND OF THE INVENTION

The present invention relates to a collapsible canopy which may be used to supply shelter from sun and rain for outdoor activities. More specifically, the present invention relates to a collapsible canopy similar to an umbrella.

In an umbrella-type canopy commercially available for protection from the whether, a flaccid cover is supported by a central standard and is held extended by pivoted ribs attached to the standard. Such umbrella-type canopy can only provide a limited surface area of protection because of the condition of its framework. The framework of an umbrella-type canopy must be changed so that the umbrella-type canopy can provide a large surface area of protection.

SUMMARY OF THE INVENTION

An object of the present invention is to provide a collapsible canopy which can provide an increased surface area of protection and which can be provided with one, two, three, four, or more covers each of which can be expanded or collapsed as a whole.

The collapsible canopy according to the present invention accordingly comprises a post, at least one slide bracket slideably received on the post, and at least one scissor assembly each having a first side and a second side and being formed by a plurality of scissor units connected in end-to-end relation. Each scissor unit is formed by a pair of cross members which are pivotally connected to each other at their midpoints. One of the scissor units at said first side has one cross member pivotally connected at the end thereof to the top end of said post and the other cross member pivotally connected at the end thereof to its respective slide bracket. A plurality of pairs of upper and lower connecting members are provided for each scissor assembly, in which one pair of upper and lower connecting members are pivotally connected to their respective outer ends of two cross members of the scissor unit at the second side, and each of the other pairs of upper and lower connecting members are pivotally connected at some pair of the upper and lower connections of two adjacent scissor units to their respective ends of four cross members. A plurality of cover support members and a plurality of strutting members are arranged for each pair of upper and lower connecting members, in which the plurality of cover support members are pivotally connected at the ends thereof to the upper connecting member, and the plurality of strutting members are each pivotally connected at one end thereof to the lower connecting member and at the other end thereof to the middle portion of its respective cover support member. At least one reeling device each being attached to said post and having a cable fixedly attached to one of the at least one slide bracket is provided for expanding the collapsible canopy.

BRIEF DESCRIPTION OF THE DRAWINGS

The present invention will become apparent from the following detailed description of some preferred embodiments when taken together with the accompanying drawings, in which.

DETAILED DESCRIPTION OF THE INVENTION

Figure 1:
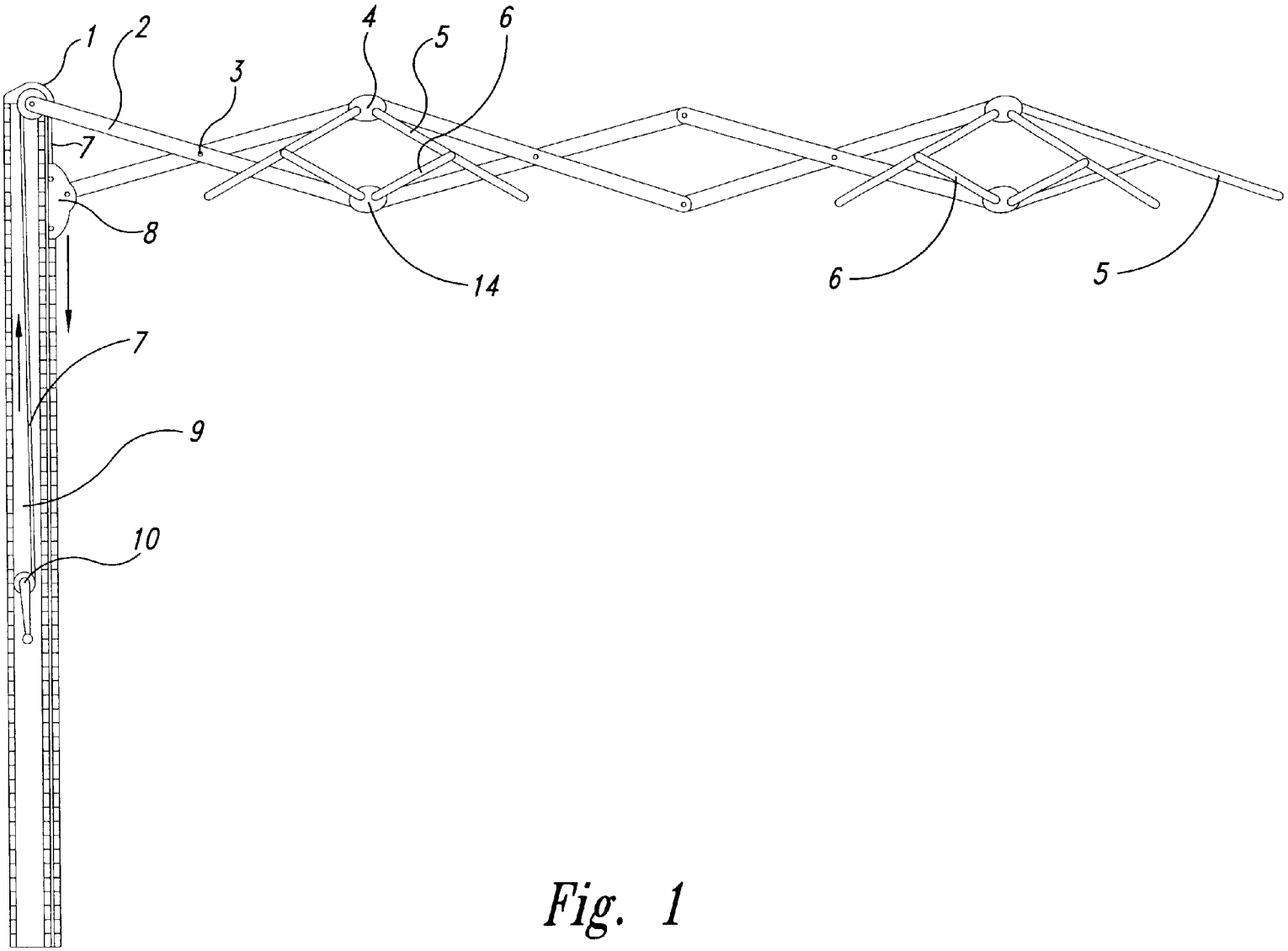
FIG. 1 is a side view in elevation of a collapsible canopy with one cover according to a first embodiment of the present invention.

With reference to FIG. 1, a collapsible canopy according to a first embodiment is shown in an expanded state and includes a post 9, a slide bracket 8 slideably received on post 9, and a scissor assembly. The scissor assembly comprises a first scissor unit, a second scissor unit and a third scissor unit connected in end-to-end relation. Each scissor unit is formed by a pair of cross members 2 which are pivotally connected to each other at their midpoints by means of a joint 3. The first scissor unit has cross members 2 pivotally connected at their ends to the top end of post 9 and slide bracket 8, respectively. At the upper and lower connections of the first and second scissor units, a pair of dome shaped connecting members, i.e., an upper connecting member 4 and a lower connecting member 14, are pivotally connected to their respective ends of cross members 2. Another pair of connecting members are pivotally connected to their respective outer ends of the cross members of the third scissor unit. A plurality of cover support members 5 are each pivotally connected at one end to upper connecting member 4. A plurality of strutting members 6 are each pivotally connected at one end to lower connecting member 14 and at the other end to the middle portion of its respective cover support member 5. A cable 7 from the cable drum of a reeling device 10 attached to post 9 extends around a rotary wheel 1 and is fixedly attached to slide bracket 8.

In FIG. 1, two arrows represent the moving directions of cable 7 and slide bracket 8, respectively, when the canopy is being collapsed.

Figure 2:
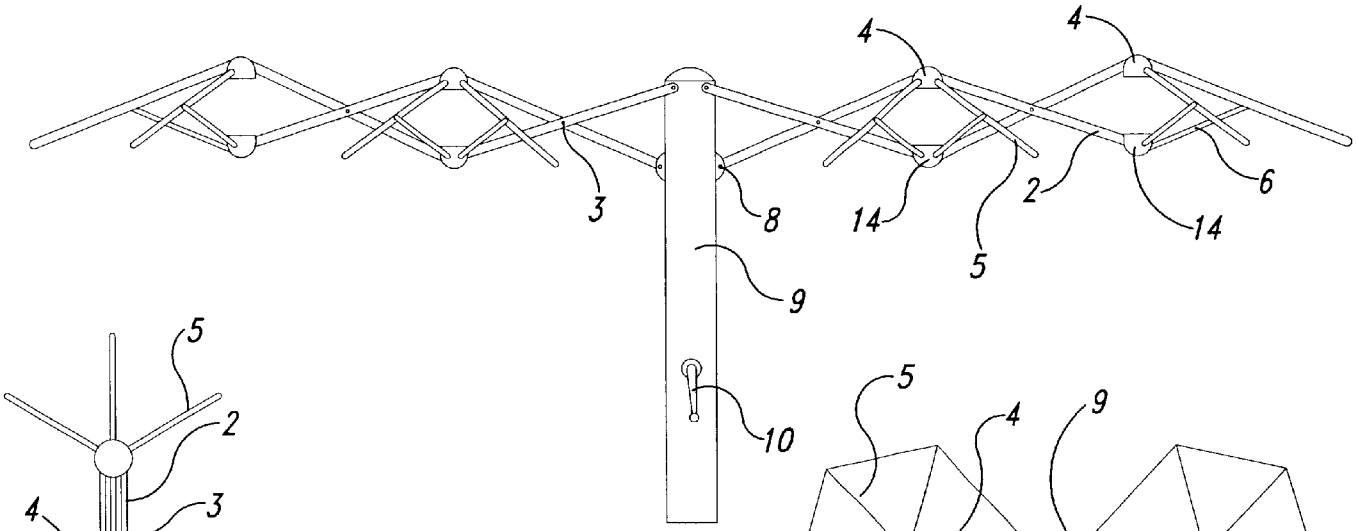
FIG. 2 is a side view in elevation of a collapsible canopy with two covers according to a second embodiment of the present invention.

A collapsible canopy with two covers according to a second embodiment, as shown in FIG. 2, is provided with two scissor assemblies connected to a post 9. Each scissor assembly has a first scissor unit and a second scissor unit connected with each other at the ends. The cross members 2 of the first scissor unit of each scissor assembly are pivotally connected at their ends to the top end of post 9 and a slide bracket 8, respectively. At the upper and lower connections of the first and second scissor units, as in the first embodiment of the invention, a pair of dome shaped connecting members 4, 14 are pivotally connected to the their respective ends of four cross members 2. Another pair of connecting members 4, 14 are pivotally connected to their respective outer ends of the cross members of the second scissor unit. Cover support members 5, strutting members 6 and each pair of connecting members 4, 14 are connected together in the same manner as in the first embodiment.

Figure 3:
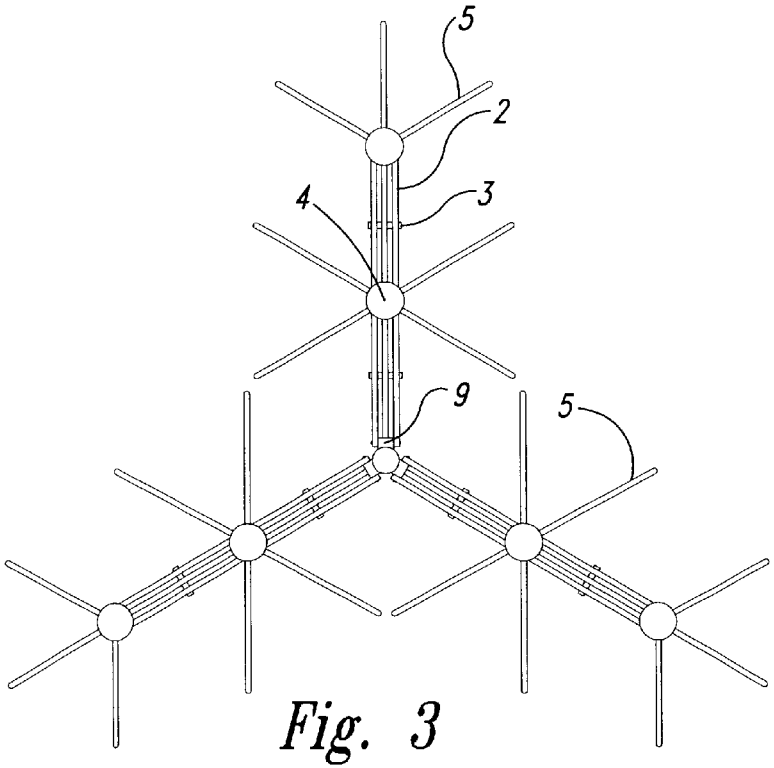
FIG. 3 is a top view of a collapsible canopy with three covers according to a third embodiment of the present invention.

Now referring to FIG. 3, there is shown a collapsible canopy with three covers according to a third embodiment of the present invention. The collapsible canopy with three covers has three scissor assemblies which each are connected to a post 9 in the same way as in the second embodiment. In the third embodiment, each pair of cross members 2 has one cross member 2 formed of a pair of rods.

Figure 4:
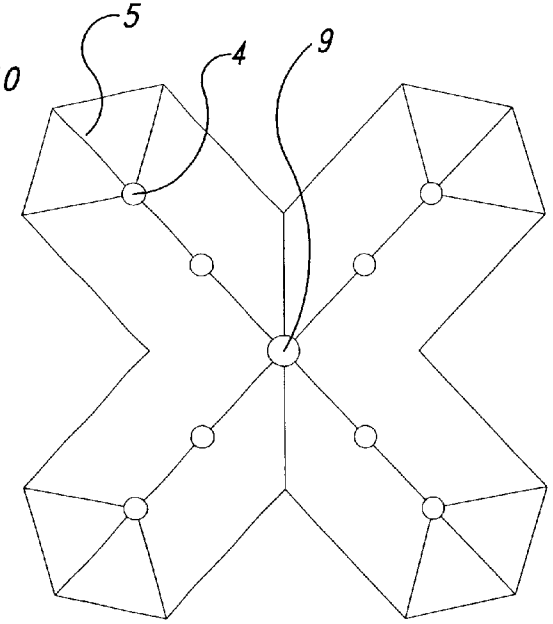
FIG. 4 is a top view of a collapsible canopy with four covers according to a fourth embodiment of the present invention, in which covers are installed.

A top view of a collapsible canopy with four covers according to a fourth embodiment of the present invention is shown in FIG. 4. The covers of the collapsible canopy of this embodiment are installed. The collapsible canopy with four covers has four scissor assemblies which each are connected to a post 9 in the same way as in the second embodiment.

In the four embodiments of the invention, each pair of connecting members 4, 14, cover support members 5 and strutting members 6 arranged for the pair of connecting members are connected together in the same manner as in the first embodiment.

For a collapsible canopy with more than one cover, the surface areas of protection of covers may be same or different, and the scissor assemblies may be angularly either equispaced as shown in FIGS. 2–4 or non-equispaced.

Figure 5:
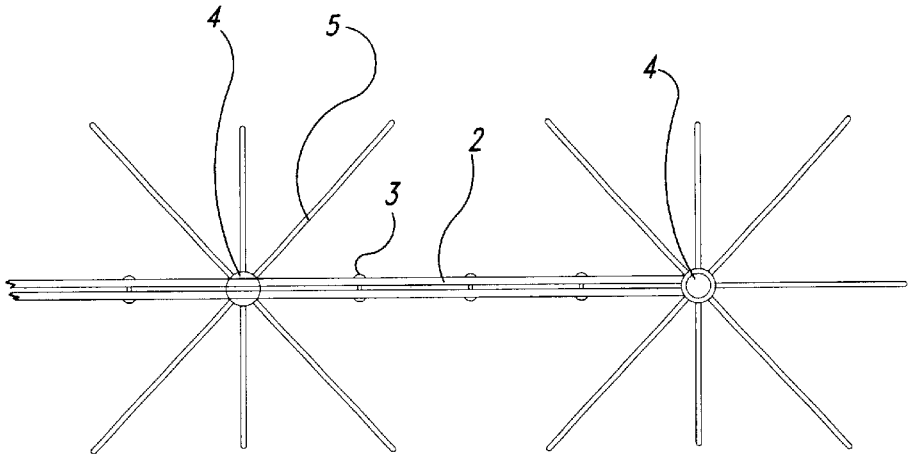
FIG. 5 is a top view of a scissor assembly with three scissor units in which each cross member is formed by one rod.

A scissor assembly according to the invention, as shown in FIG. 5, has three scissor units. Each scissor unit is formed by two cross members 2 pivoted together at their midpoints by means of a joint 3, each cross member 2 being formed by one rod.

Figure 6:
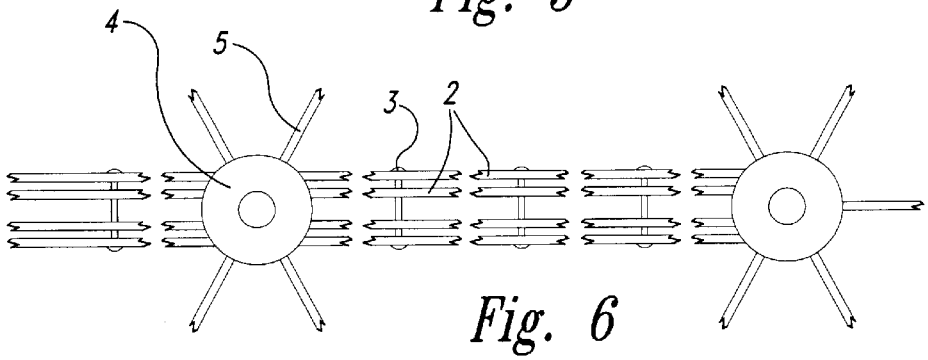
FIG. 6 is a top view of a scissor assembly with three scissor units in which each cross member is formed by two rods.

A scissor assembly as shown in FIG. 6 comprises three scissor units. Each scissor unit is formed by two cross members 2 pivoted together at their midpoints by means of a joint 3, each cross member 2 being formed by two rods.

A scissor assembly may have two, three or more scissor units. The number of pairs of connecting members 4, 14 may be increased with the number of the scissor units being increased.

In accordance with the size of a cover, each pair of cross members pivotally connected together at their midpoints by a joint may be formed by two, three, four or five rods.

The number of a plurality of cover support members 5 and that of a plurality of strutting members 6 for each pair of connecting members may be determined in accordance with the size of the cover supported by the cover support members 5.

At the upper connections of two scissor units which connections are not provided with upper connecting members, means for fastening a cover to a scissor assembly may be arranged.

Figure 7:
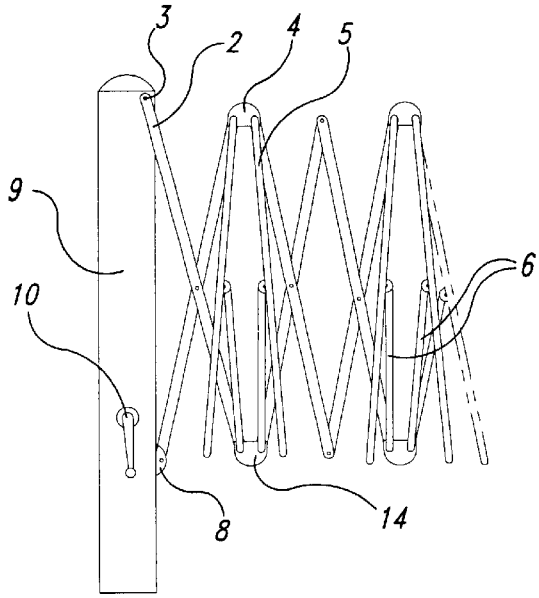
FIG. 7 shows the collapsible canopy according to the first embodiment in a nearly collapsed state.

The reeling device as shown in FIGS. 1, 2, 7 is a manual operated device comprising a cable drum rotatably attached to a hollow post 9 and a handle fixedly attached to the cable drum. In post 9, a cable from the cable drum extends around a rotary wheel and is fixed secured to a slider bracket. The cable drum can be clockwise or anticlockwise rotated by means of the handle so that the cable is extended or retracted for collapsing or expanding a scissor assembly.

The cable may be a cord, a steel rope or a chain. In the case the cable is a chain, the rotary wheel is a sprocket.

A reeling device for reeling and unreeling a cable may be located at the top end of post 9, and the cable is directly attached to the slide bracket.

According to the invention, a reeling device may be designed to be a motor-operated device. In this case, a switch or a remote control unit may be provided to control the reeling device.

For a collapsible canopy with more than one scissor assembly according to the invention, it is possible that only one reeling device is provided for all the slide brackets which are connected together and which each are arranged for one scissor assembly. It is also possible that the scissor assemblies are divided into some groups and each group is allocated with one reeling device or that each assembly is provided with one reeling device.

In case where a larger moment must be applied to the cable drum of a reeling device for expanding a collapsible canopy of the invention, it is possible either that a gear drive such as a worm gear drive is arranged between a handle or a motor and the cable drum or that a block and tackle is adopted.

The collapsible canopy according to the invention is simple in the structure thereof, inexpensive to manufacture, and convenient to use.

What is claimed is:

1. A collapsible canopy comprising:

a post;

at least one slide bracket slideably connected on said post;

at least one scissor assembly having a first side and a second side formed by a plurality of scissor units connected in end-to-end relation, each said scissor unit being a pair of cross members which are pivotally connected to each other at their midpoints, one of said scissor units being located at said first side having one of the said pair of cross members pivotally connected at an end thereof to a top end of said post and the other of said pair of cross members pivotally connected at an end thereof to the slide bracket;

a plurality of pairs of upper and lower connecting members provided for each scissor assembly, in which one of the pair of upper and lower connecting members are pivotally connected to outer ends of the pair of cross members of one of the plurality of scissor units, the one of the plurality of scissor units being located at said second side, and each of the other pairs of upper and lower connecting members are pivotally connected to ends of four cross members of two adjacent scissor units;

a plurality of cover support members and a plurality of strutting members provided for each pair of upper and lower connecting members, in which said plurality of cover support members are each pivotally connected at an end thereof to one of the plurality of upper connecting members, and said plurality of strutting members are each pivotally connected at one end thereof to one of the plurality of lower connecting members and at the other end thereof to a middle portion of at least one of the cover support members; and at least one reeling device being attached to said post and having a cable fixedly attached to the at least one slide bracket.

2. A collapsible canopy according to claim 1, wherein there are at least two assemblies, and a surface area of protection of a cover for each assembly is the same for each assembly.

3. A collapsible canopy according to claim 1, wherein there are at least two assemblies, and a surface area of protection of a cover for each assembly is different for each assembly.

4. A collapsible canopy according to claim 1, wherein each pair of cross members are formed by at least two rods.

5. A collapsible canopy according to claim 1, wherein said reeling device is manual operated.

6. A collapsible canopy according to claim 1, wherein said reeling device is motor-operated.

7. A collapsible canopy according to claim 1, wherein said cable is a rope or chain.

8. A collapsible canopy comprising:

a post;

at least one slide bracket slideably connected to the post;

a plurality of scissor units connected in end-to-end relation to form at least one scissor assembly, the scissor assembly having an inner end proximate the post and an outer end away from the post, each scissor unit of the assembly comprising a pair of cross members which are pivotally connected to each other, with one of the scissor units being located at the inner end having one of the pair of cross members pivotally connected to the post and the other of the pair of cross members pivotally connected to the slide bracket;

a plurality of cover support members, each pivotally connected at an end thereof to at least one of the scissor units;

at least one reeling device attached to the post having a cable fixedly attached to the at least one slide bracket; and at least one cover disposed over at least a portion of the at least one scissor assembly.

9. The collapsible canopy of claim 8 further comprising a plurality of struts, each having a lower end and an upper end, the lower end being connected to at least one of the scissor units, and an upper end being connected to at least one of the cover support members.

10. The collapsible canopy of claim 8 further wherein there are at least two scissor assemblies, and the at least one cover is disposed over at least a portion of each assembly, and a surface area of protection of the at least one cover is the same for each assembly.

11. The collapsible canopy of claim 8 further wherein there are at least two scissor assemblies, and the at least one cover is disposed over at least a portion of each assembly, and a surface area of protection of the at least one cover is different for each assembly.

12. The collapsible canopy of claim 8 wherein each pair of cross members comprises at least two rods.

13. The collapsible canopy of claim 8 wherein the reeling device is manually operated.

14. The collapsible canopy of claim 8 wherein the reeling devise is motor-operated.

15. The collapsible canopy of claim 8 wherein the cable is a rope or chain.

16. The collapsible canopy of claim 8 wherein each scissor unit has an inside end and an outside end, the outside end being further from the post than the inside end, and at least one of the plurality of cover support members is attached to the scissor assembly proximate to each outside end of each scissor unit.

* * * * *

UNITED STATES PATENT AND TRADEMARK OFFICE

CERTIFICATE OF CORRECTION

PATENT NO. : 6,230,727 B1
DATED : May 15, 2001
INVENTOR(S) : Fengchun Chen

It is certified that error appears in the above-identified patent and that said Letters Patent is hereby corrected as shown below:

Column 4, claim 1,
Line 27, "of said pair" should read -- of the said pair --.

Column 6, claim 14,
Line 17, "devise is motor-operated" should read -- device is motor-operated --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*